US009416530B2

(12) United States Patent
Espinosa

(10) Patent No.: US 9,416,530 B2
(45) Date of Patent: Aug. 16, 2016

(54) CONCRETE ANCHOR

(71) Applicant: Thomas M Espinosa, Snohomish, WA (US)

(72) Inventor: Thomas M Espinosa, Snohomish, WA (US)

( * ) Notice: Subject to any disclaimer, the term of this patent is extended or adjusted under 35 U.S.C. 154(b) by 0 days.

(21) Appl. No.: 14/742,835

(22) Filed: Jun. 18, 2015

(65) Prior Publication Data

US 2015/0308101 A1 Oct. 29, 2015

Related U.S. Application Data

(62) Division of application No. 12/656,624, filed on Feb. 4, 2010, now Pat. No. 9,097,001.

(60) Provisional application No. 61/202,186, filed on Feb. 4, 2009, provisional application No. 61/295,316, filed on Jan. 15, 2010.

(51) Int. Cl.

| | |
|---|---|
| ***E04B 1/41*** | (2006.01) |
| ***E04B 1/26*** | (2006.01) |
| *E04B 1/35* | (2006.01) |

(52) U.S. Cl.

CPC ..... *E04B 1/4157* (2013.01); *E04B 1/2604* (2013.01); *E04B 2001/268* (2013.01); *E04B 2001/2652* (2013.01); *E04B 2001/3583* (2013.01)

(58) Field of Classification Search

CPC ... E04B 1/4114; E04B 1/4121; E04B 1/4128; E04B 1/4157; E04B 1/4164; E04B 2001/268; E04B 2001/2684; E04G 17/0658

USPC ..... 52/223.13, 295, 704, 699

See application file for complete search history.

(56) References Cited

U.S. PATENT DOCUMENTS

| | | | | |
|---|---|---|---|---|
| 991,517 | A | | 5/1911 | Kennedy |
| 1,022,826 | A | | 4/1912 | Chatfield |
| 1,045,562 | A | | 11/1912 | Kennedy |
| 1,070,663 | A | * | 8/1913 | Bierce ..... E02D 5/80 114/294 |
| 1,157,895 | A | | 10/1915 | Murphy et al. |
| 1,185,765 | A | | 6/1916 | Brooks |
| 1,264,189 | A | | 4/1918 | Keator |
| 1,447,515 | A | | 3/1923 | Miller |
| 1,756,534 | A | | 4/1930 | Chance |
| 1,940,545 | A | | 12/1933 | Holmes |
| 2,380,692 | A | | 7/1945 | Gunnison |
| 2,625,815 | A | | 1/1953 | Black |
| 3,157,966 | A | | 11/1964 | Sherbume |
| 3,224,591 | A | | 12/1965 | Sawyer |
| 3,301,298 | A | | 1/1967 | Stover, III |
| 3,391,514 | A | | 7/1968 | Hall, Jr. |
| 3,405,497 | A | | 10/1968 | McNair |

(Continued)

FOREIGN PATENT DOCUMENTS

| | | |
|---|---|---|
| EP | 0 765 977 | 4/1997 |
| FR | 573 784 | 6/1924 |

(Continued)

*Primary Examiner* — Robert Canfield

(74) *Attorney, Agent, or Firm* — Shlesinger, Arkwright & Garvey LLP

(57) ABSTRACT

An anchor for supporting a load comprises an anchor rod having a lower threaded portion for being embedded in a concrete structure and an upper portion for extending outside the concrete structure; a metallic body attached to the lower portion, the body including a top surface and a bottom surface joined by a vertical side surface; and the side surface including at least one shoulder extending therefrom.

15 Claims, 21 Drawing Sheets

(56) References Cited

U.S. PATENT DOCUMENTS 3,418,781 A 12/1968 Penote
3,443,351 A 5/1969 Kumazawa
3,509,670 A 5/1970 Boll et al.
3,514,917 A 6/1970 Merrill, Sr.
3,685,783 A 8/1972 Hilson
3,867,804 A 2/1975 Wilson
3,884,004 A 5/1975 Douma et al.
3,927,497 A 12/1975 Yoshinaga et al.
3,935,685 A 2/1976 Howlett
4,075,925 A 2/1978 Lerich
4,169,569 A 10/1979 Riegler et al.
4,195,709 A 4/1980 Gianotti et al.
4,239,489 A 12/1980 Ellmas et al.
4,287,807 A 9/1981 Pacharis et al.
4,315,393 A * 2/1982 Schack ..... E04B 1/4128 411/427
4,325,575 A 4/1982 Holt et al.
4,351,139 A * 9/1982 Gander ..... E04G 21/125 52/378
4,368,606 A * 1/1983 Hoshino ..... E04B 1/4128 52/709
4,408,940 A 10/1983 Fischer
4,412,407 A * 11/1983 Melfi ..... E04G 21/185 52/309.1
4,470,736 A 9/1984 Tasseron
4,623,170 A * 11/1986 Cornwall ..... E04G 15/061 249/177
4,624,086 A * 11/1986 MacKay ..... E04G 15/061 248/56
4,650,276 A 3/1987 Lanzisera et al.
4,656,806 A * 4/1987 Leibhard ..... F16B 13/065 411/15
4,681,496 A 7/1987 Fasolino
4,945,704 A 8/1990 Brown, Jr.
5,082,399 A 1/1992 Frease et al.
5,085,547 A 2/1992 Vanotti
5,205,690 A 4/1993 Roth
5,226,770 A 7/1993 Walson
5,375,384 A 12/1994 Wolfson
5,415,510 A * 5/1995 Funaki ..... E04G 17/0658 411/384
5,641,256 A 6/1997 Gundy
5,653,078 A 8/1997 Kies et al.
5,653,563 A 8/1997 Ernst et al.
5,740,651 A 4/1998 Vanotti
5,772,372 A 6/1998 Lins et al.
5,937,609 A * 8/1999 Roth ..... E04B 1/4121 52/698
6,161,339 A 12/2000 Cornett et al.
6,185,886 B1 * 2/2001 Gruen ..... E02D 5/80 52/223.13
6,240,697 B1 6/2001 Thompson et al.
6,341,452 B1 1/2002 Bollinghaus
6,350,093 B1 2/2002 Petersen et al.
6,513,300 B1 2/2003 James
6,585,468 B2 7/2003 Johnson et al.
6,769,852 B2 8/2004 Nilsen et al.
7,093,400 B1 8/2006 Thompson et al.
7,144,530 B2 12/2006 Ward et al.
7,150,132 B2 12/2006 Commins
7,174,679 B1 2/2007 Mueller
7,296,382 B2 11/2007 Sack
7,445,192 B2 11/2008 Gridley et al.
7,752,824 B2 7/2010 Brown et al.
7,946,086 B2 5/2011 Hammer et al.
7,971,411 B2 7/2011 Commins
8,051,615 B2 11/2011 Mathews et al.
8,136,318 B2 3/2012 Espinosa
8,621,816 B1 1/2014 Lin et al.
2002/0050113 A1 * 5/2002 Peacock ..... H02G 3/12 52/704
2002/0071740 A1 6/2002 Ward
2003/0152442 A1 8/2003 Curley et al.
2006/0137285 A1 6/2006 Brown
2008/0282640 A1 11/2008 Mathews et al.
2008/0314112 A1 12/2008 Park et al.
2009/0028666 A1 1/2009 Nakamura
2011/0041449 A1 2/2011 Espinosa
2015/0013264 A1 * 1/2015 Garot ..... E04B 1/4121 52/699

FOREIGN PATENT DOCUMENTS

FR 1 067696 6/1954
GB 1 090554 11/1967

* cited by examiner

CONCRETE ANCHOR

RELATED APPLICATIONS

This is a divisional application of nonprovisional application Ser. No. 12/656,624, filed Feb. 4, 2010, claiming the priority benefits of provisional application Ser. Nos. 61/202,186 and 61/295,316, filed Feb. 4, 2009 and Jan. 15, 2010, respectively, and all three applications are hereby incorporated by reference.

FIELD OF THE INVENTION

The present invention relates generally to an anchor embedded in a concrete structure for transferring load to the concrete structure, and particularly to an anchor embedded in a concrete structure, such as a foundation, beam or deck for attaching thereto another structure, such as a wall.

SUMMARY OF THE INVENTION

The present invention provides an anchor for supporting a load comprises an anchor rod having a lower threaded portion for being embedded in a concrete structure and an upper portion for extending outside the concrete structure; a metallic body attached to the lower portion, the body including a top surface and a bottom surface joined by a vertical side surface; and the side surface including at least one shoulder extending therefrom.

The present further provides an anchor for supporting a load, comprising an anchor rod having a lower threaded portion for being embedded in a concrete structure and an upper portion for extending outside the concrete structure; a metallic tubular body attached to the lower portion, the tubular body including a sidewall, a top opening and a bottom opening, the sidewall including inside and outside surfaces. The outside surface including at least one shoulder extending outwardly therefrom; and the inside surface includes an inverted shoulder extending inwardly therefrom.

The present invention also provides an anchor for supporting a load, comprising an anchor rod having a lower threaded portion for being embedded in a concrete structure and an upper portion for extending outside the concrete structure; a metallic wedge-shaped body attached to the lower portion, the body including a circular cross-section and a circular top surface and a circular bottom surface joined by a vertical side surface.

DETAILED DESCRIPTION OF THE INVENTION

Figure 1:
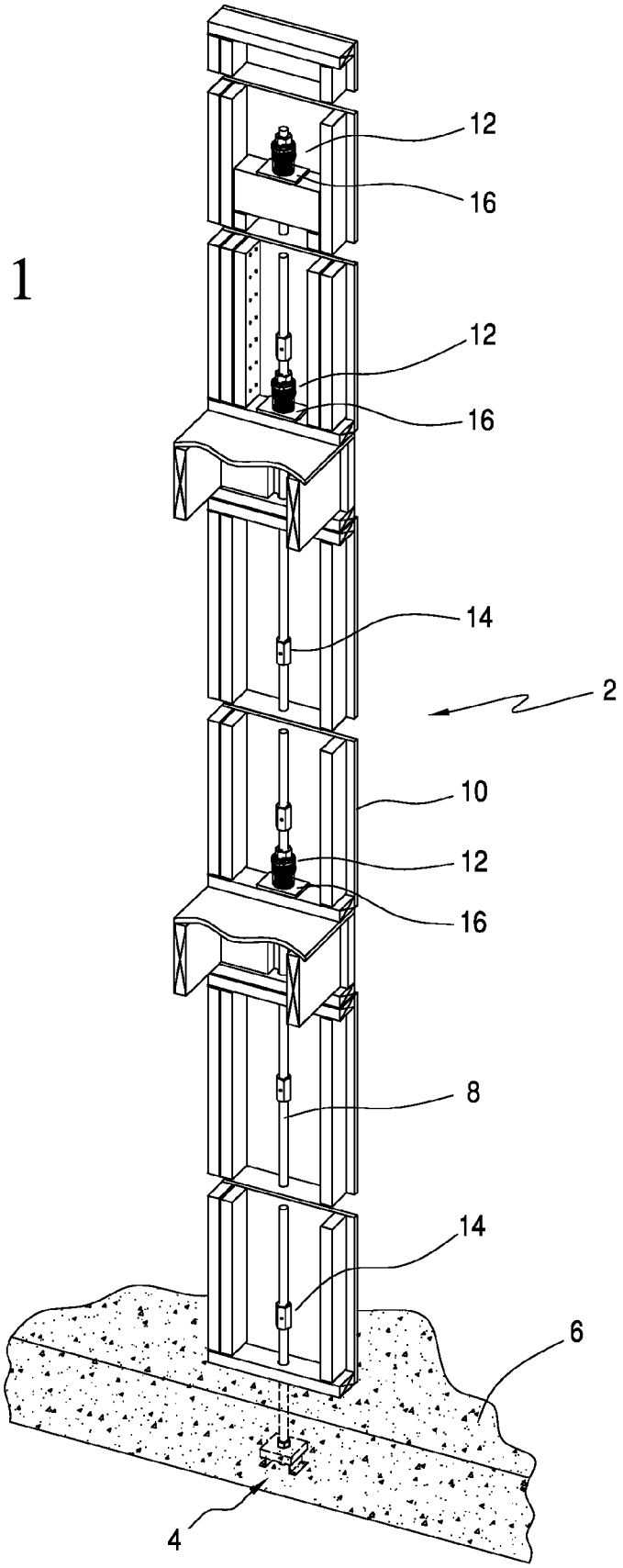
FIG. 1 is a perspective view of a portion of a wall system anchored to a concrete structure.

Referring to FIG. 1, a wall system 2 comprises an anchor 4 embedded in a concrete structure, such as a concrete deck, beam, slab or foundation 6. The anchor 4 is used to transfer load to the concrete structure. The load may be in the form of another structure, such as a wall, required to be tied down to the concrete structure 6.

Using as an example a wall that is required to be secured to a concrete foundation or decking, the anchor is connected to a tie rod 8 that extends inside a stud wall 10 through several floors. The tie rod 8 is secured to the wall 10 at several locations with a fastener assembly 12 that expands to take up any slack that may develop in the tie rod due to wood shrinkage, load compression, load shifting, etc. after installation. Connectors 14 are used to connect several sections of the tie rod 8 to make one interconnected continuous length. Bearing plates 16 are used to spread the force exerted by the fastener assemblies 12 over the wood members. Examples of the fastener assemblies 12 are disclosed in applicant's co-pending application Ser. No. 11/898,479, herein incorporated by reference.

Figure 2:
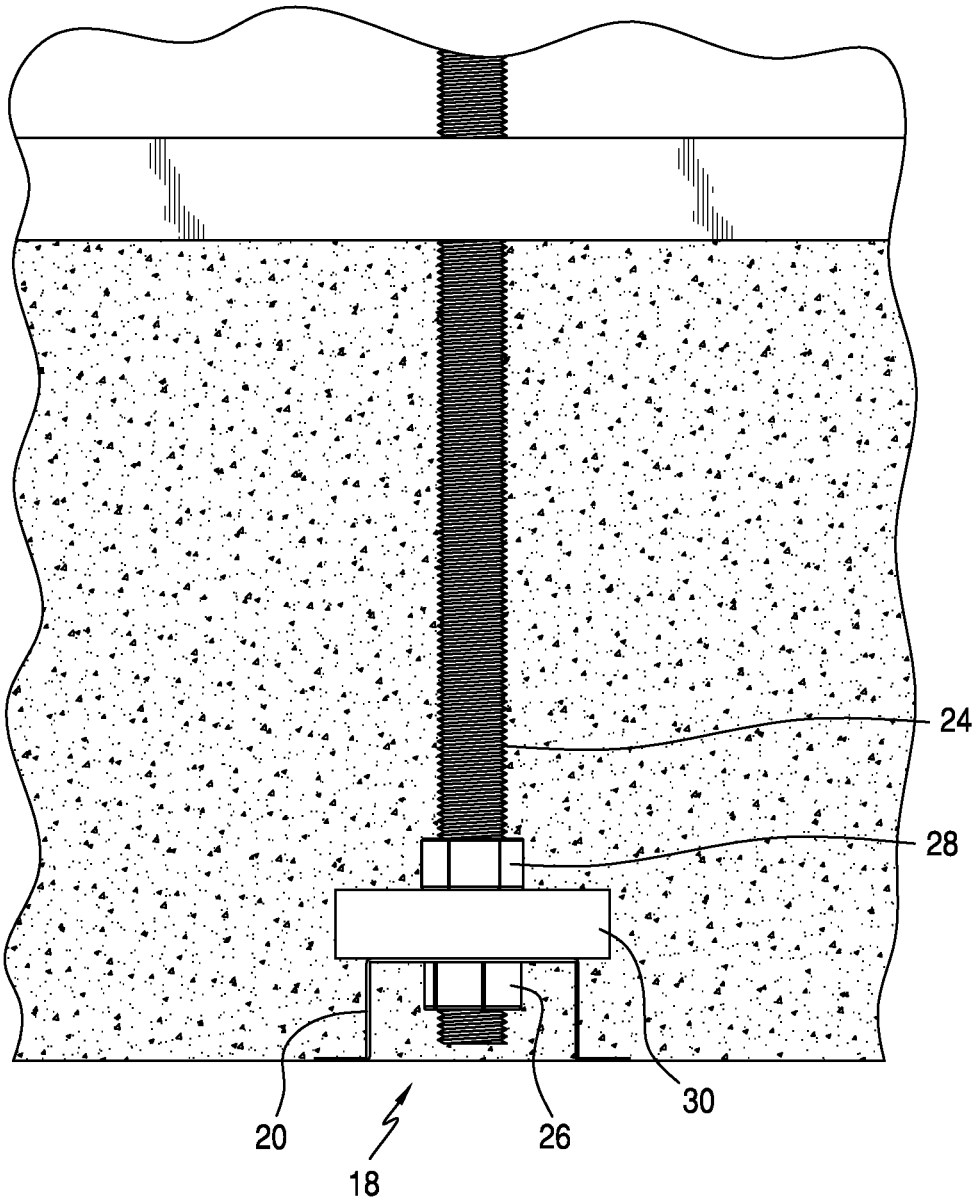
FIG. 2 PRIOR ART
FIG. 2 is a side elevation view of a prior art anchor shown in FIG. 1.
Figure 3:
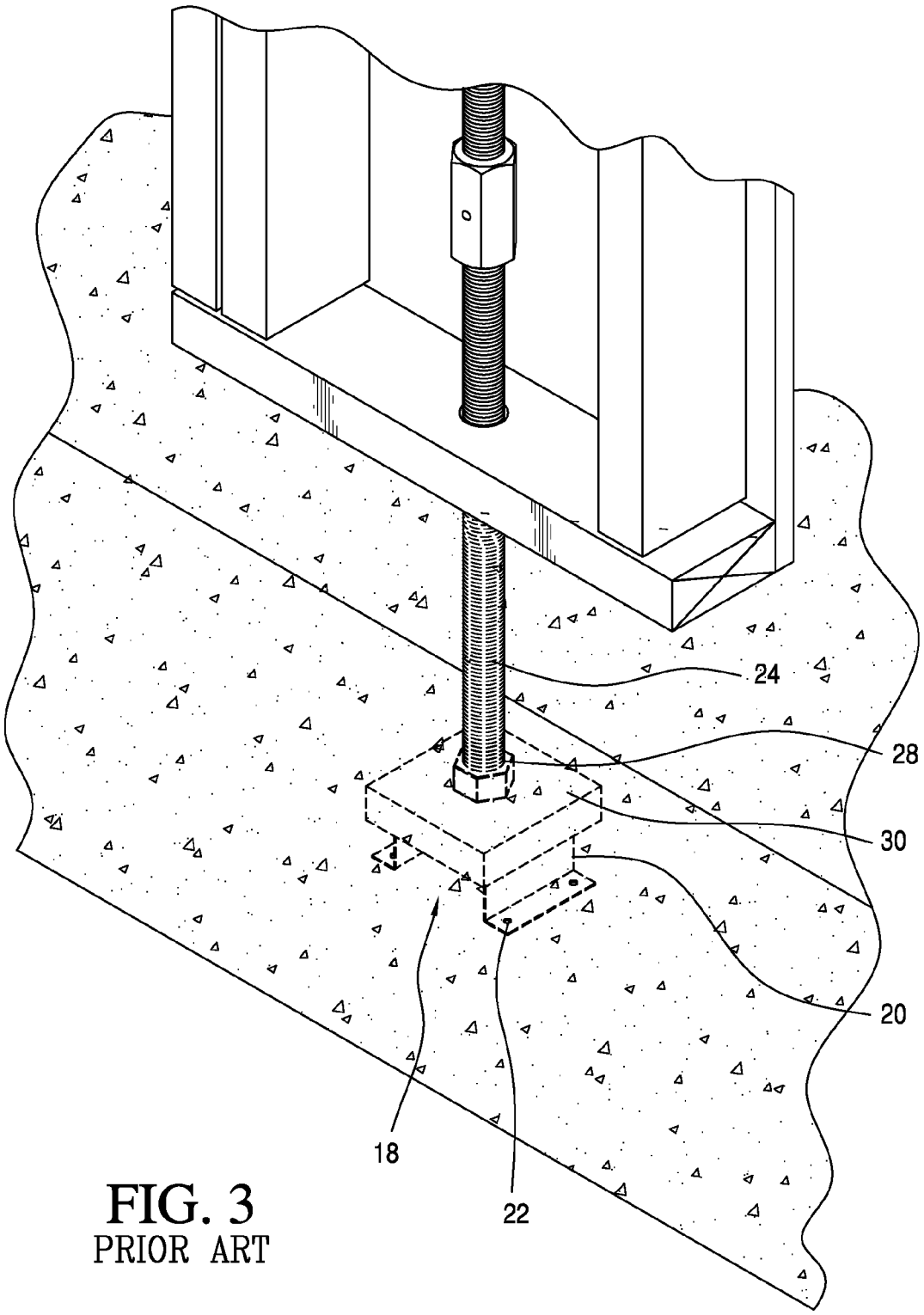
FIG. 3 PRIOR ART
FIG. 3 is a perspective view of FIG. 2.

Referring to FIGS. 2 and 3, a prior art anchor 18 includes a U-shaped sheet metal support 20 secured to a form board by means of nails through holes 22. A threaded anchor rod 24 has its one end secured to the support 20 by means of a bottom nut 26 and a top nut 28. An intervening plate 30 seats on top of the support 20.

Figure 4:
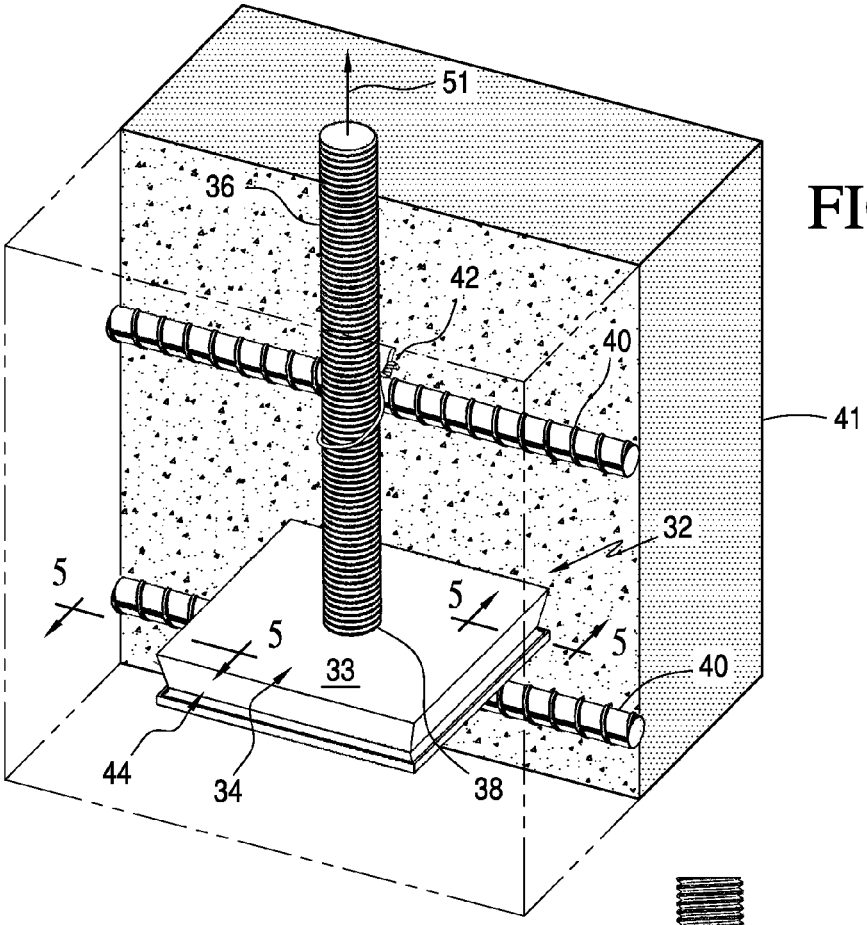
FIG. 4 is a perspective view of an anchor made in accordance with the present invention, showing an anchor body attached to an anchor rod, which is attached to rebars within a concrete form.

An anchor 32 made in accordance with the present is disclosed in FIG. 4. The anchor 32 includes a rectangular, metallic anchor body 34 and an anchor rod 36 screwed through a threaded opening 38 in the anchor body 34. The anchor rod 36 may be all-threaded or partially threaded. When in use, the anchor 32 is placed inside a concrete form and held in place, such as by securing to rebars 40 with tie wire 42. After concrete is poured into the concrete form, the anchor 32 becomes embedded in the concrete, generally indicated at 41, to provide anchorage. The anchor rod 36 is preferably screwed all the way through the opening 38 to extend below the anchor body 34.

The anchor body 34 is a rectangular metallic plate, preferably steel, with a top surface 33, a bottom surface 35 and vertical side surfaces 44 joined to the top and bottom surfaces. Although shown as rectangular, the anchor body 34 may be a square, pentagon, hexagon, octagon, etc. Each of the side surfaces 44 of the anchor body 34 has a recessed profile, as shown in FIG. 5.

Figure 5:
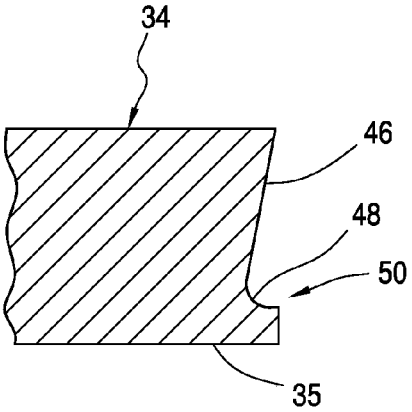
FIG. 5 is an enlarged, fragmentary cross-sectional view taken along the line 5-5 in FIG. 4.

Referring to FIG. 5, each side surface 44 has a downwardly and inwardly projecting surface 46 and an outwardly extending surface 48 to create a shoulder 50 near the bottom surface 35. The surface 48 preferably starts at the top surface 34 and preferably terminated at the surface 48. The surface 48 is preferably curved. The surface 46 may be planar, as shown. However, the profile can be of any shape as long as it is generally recessed to form the shoulder 50. Accordingly, the surface 46 can be curved, corrugated, etc. The creation of the shoulder 50 enables the side surface 44 to resist a tensile load generally indicated at 51. Further, by locating the shoulder 50 in a lower position closer to the bottom surface 35, a larger shear cone 53, shown in FIG. 6, will be generated when the anchor rod 36 is put under tension, resulting in a stronger anchorage.

Figure 6:
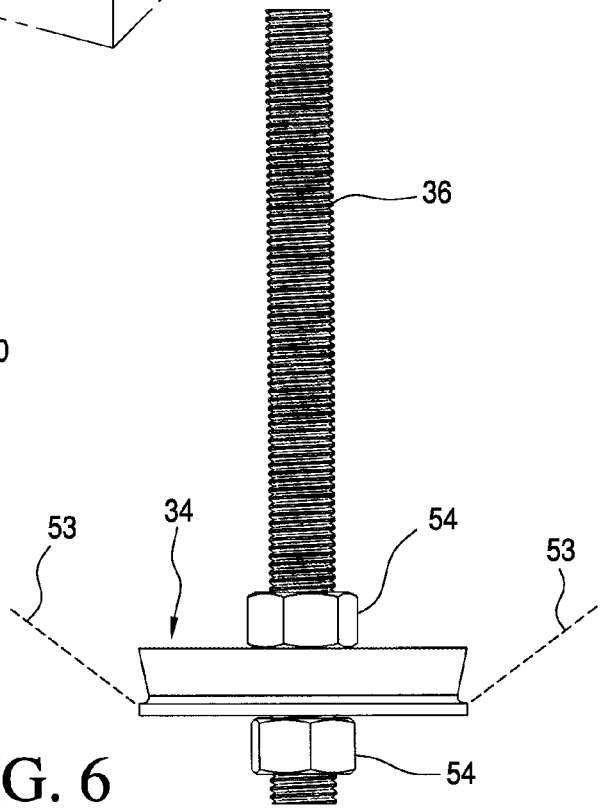
FIG. 6 is a side-elevational view of the anchor of FIG. 4, showing upper and bottom nuts to attach the anchor body to the anchor rod.

Referring to FIG. 6, upper and lower nuts 54 are used to secure the anchor body 34 to the anchor rod 36. In this embodiment, the opening 36 through the anchor body 36 may be left unthreaded.

Figure 7:
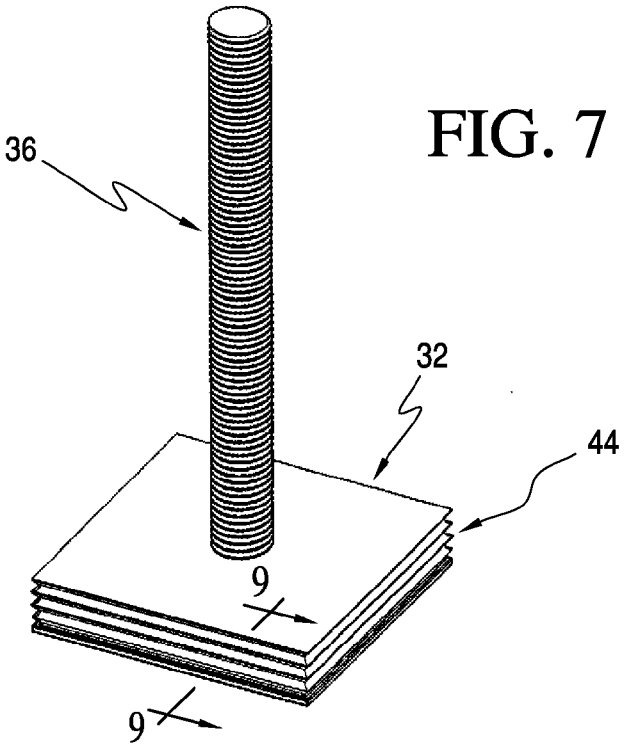
FIG. 7 is a perspective view of another embodiment of the anchor of FIG. 4.
Figure 9:
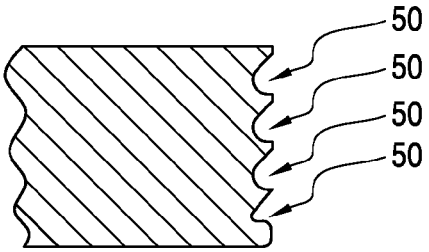
FIG. 9 is an enlarged, fragmentary cross-sectional view taken along line 9-9 in FIG. 7.
Figure 8:
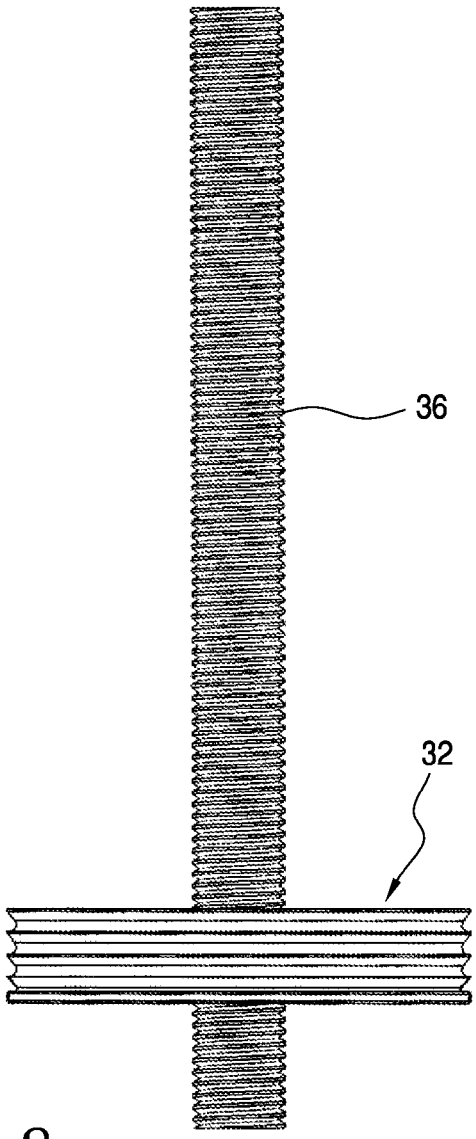
FIG. 8 is a side-elevational view of the anchor of FIG. 7.
Figure 10:
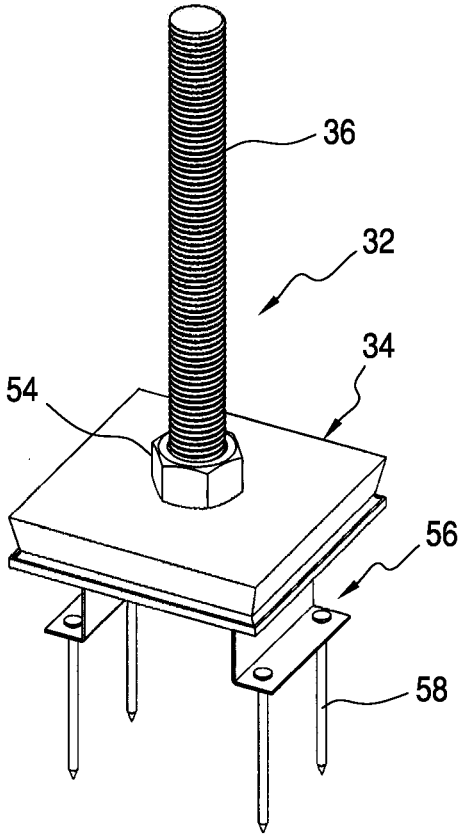
FIG. 10 is a perspective view of the anchor FIG. 6 attached to a support.

Referring to FIGS. 7, 8 and 9, the side surfaces 44 of the anchor body 34 are provided with a series of recessed profiles to provide multiple shoulders 50. Each of the profile has the same general shape as the profile shown in FIG. 5, including downwardly and inwardly projecting surfaces and outwardly extending surfaces to form respective shoulders 50. The multiple shoulders 50 advantageously help distribute the load on the entire surfaces 44, rather than being concentrated on a single shoulder. The anchor body of FIG. 7 may also use the upper and lower nuts 54 to secure the anchor body to the anchor rod, in the manner shown in FIG. 6, in addition to or in lieu of a threaded opening through the anchor body.

Figure 11:
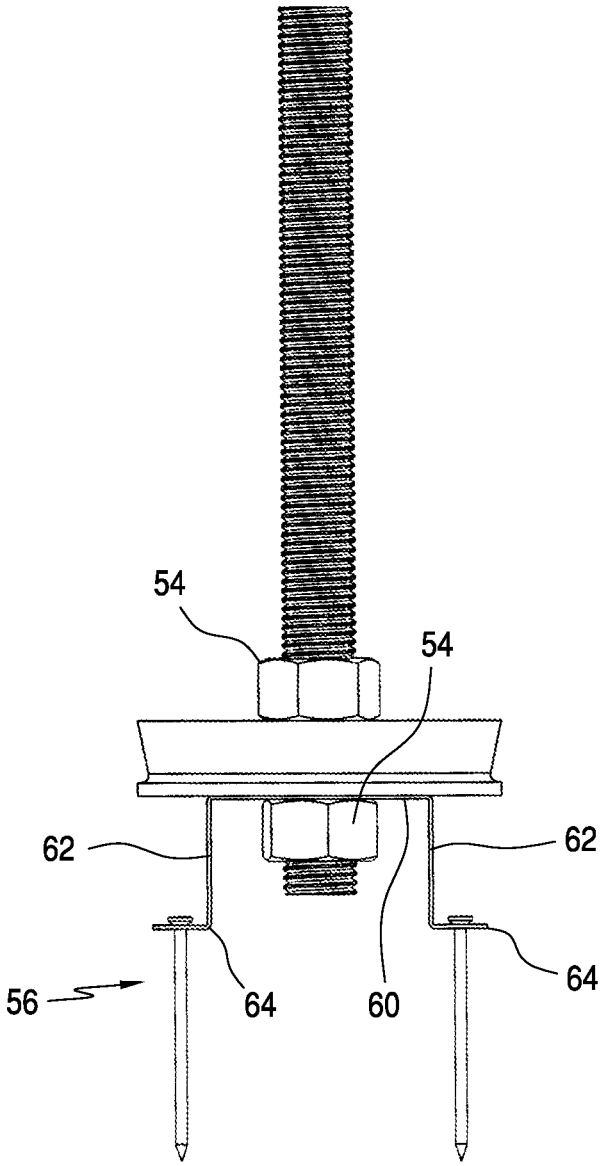
FIG. 11 is a side-elevational view of FIG. 10.

Instead of securing the anchor 32 to the rebars, the anchor body 34 and the anchor rod 36 may be supported within the concrete form by a support 56. Nails 58 attach the support 56 to a concrete form board (not shown) prior to pouring of the concrete. The support 56 preferably formed from sheet metal bent into an inverted U-shape with a base wall 60, side walls 62 extending downwardly from opposite ends of the base wall, and feet 64 extending outwardly from the bottom of the respective side walls 62. The anchor body 34 is attached to the base wall 60 by the upper and lower nuts 54, as shown in FIG. 11.

Figure 12:
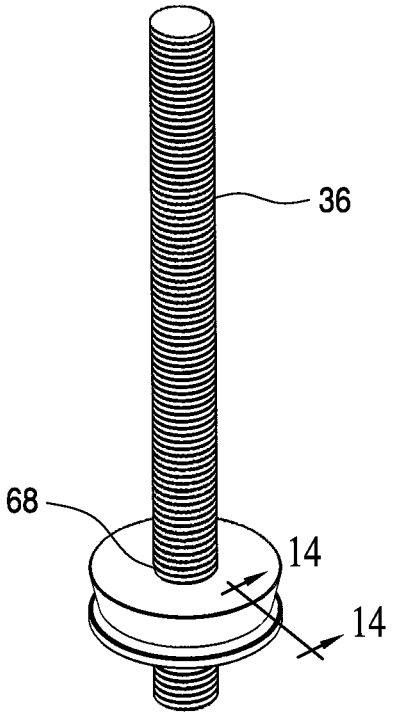
FIG. 12 is a perspective view of another embodiment of an anchor made in accordance with the present invention.
Figure 13:
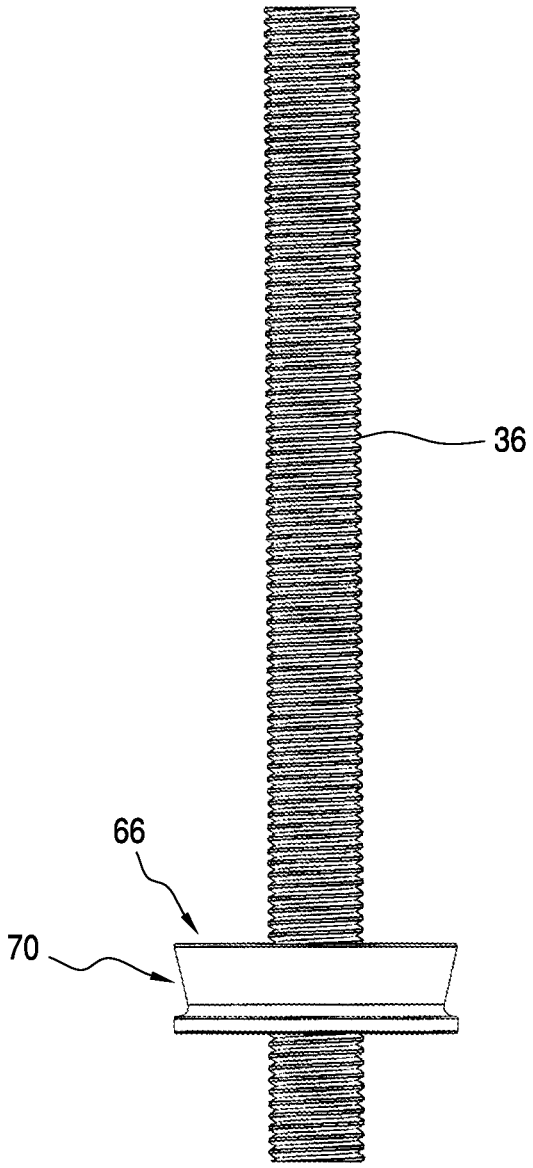
FIG. 13 is a side-elevational view of the anchor of FIG. 12.
Figure 14:
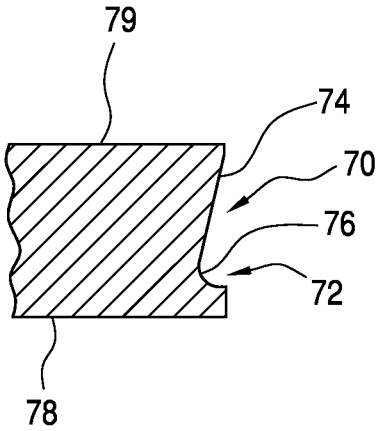
FIG. 14 is an enlarged, fragmentary cross-sectional view taken along line 14-14 in FIG. 12.

The anchor body 34 may be replaced with a metallic anchor body 66, as shown in FIGS. 12, 13 and 14. The anchor body 66 is circular in cross-section. The anchor body 66 has top and bottom circular surfaces. The anchor body 66 is threadedly secured to the anchor rod 36 via central threaded opening 68. The anchor body 66 is substantially cylindrical in shape except for the recessed profile on the sidewall surface 70 that defines a shoulder 72. The sidewall surface 70 has an inverted conical surface 74 and an outwardly curved surface 76 near the bottom surface 78. The conical surface 74 preferably starts from the top surface 79 and proceeds downwardly and inwardly. Preferably, the surface 74 terminates into the curved surface 76. As with the anchor body 34 shown in FIG. 4, locating the shoulder 72 near the bottom surface 78 provides a larger shear cone within the concrete structure in which the anchor is embedded, and thus provides a stronger anchorage.

Figure 15:
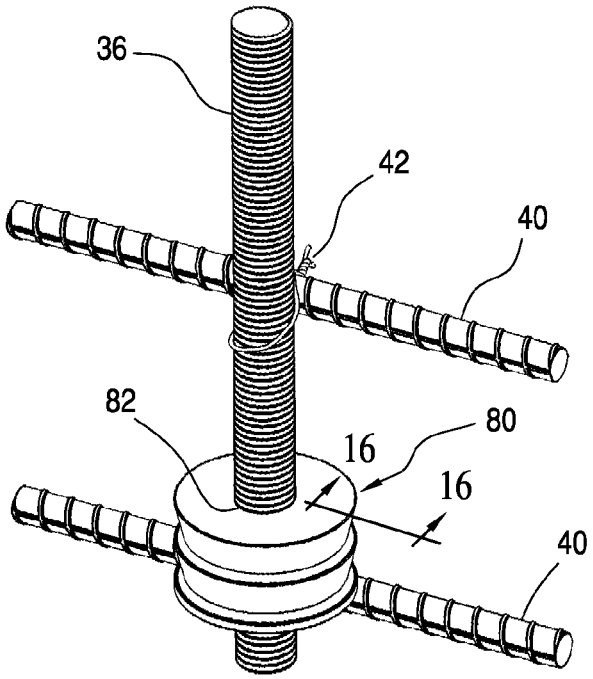
FIG. 15 is a perspective view of another embodiment of the anchor of FIG. 12, shown attached to rebars within a concrete form.
Figure 16:
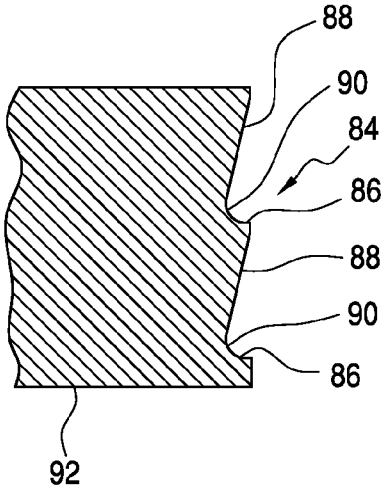
FIG. 16 is an enlarged, fragmentary cross-sectional view taken along line 16-16 in FIG. 15.

Referring to FIG. 15, another embodiment of an anchor body 80 is disclosed. The anchor body 80 is circular in cross-section. The anchor body 80 is threadedly secured to the anchor rod 36, which may be positioned within a concrete form, for example, by tying the anchor rod 36 to rebars 40 with tie wire 42. The anchor body 80 has a central threaded opening 82 in which the anchor rod 36 is threaded. The anchor body 80 is substantially cylindrical, except for its vertical side surface 84 which has a series of recessed profiles with multiple shoulders 86 formed by respective downwardly and inwardly projecting surface 88, preferably an inverted conical surface and a respective outwardly extending curved surface 90, as shown in FIG. 16. The surface 88 the preferably terminates into the surface 90. Having multiple recessed profiles with multiple shoulders 86 allows the anchor body 80 to carry a higher load. Each shoulder 86 will generate its own shear cone when the anchor is put under load, thereby providing for a stronger anchorage.

Figure 17:
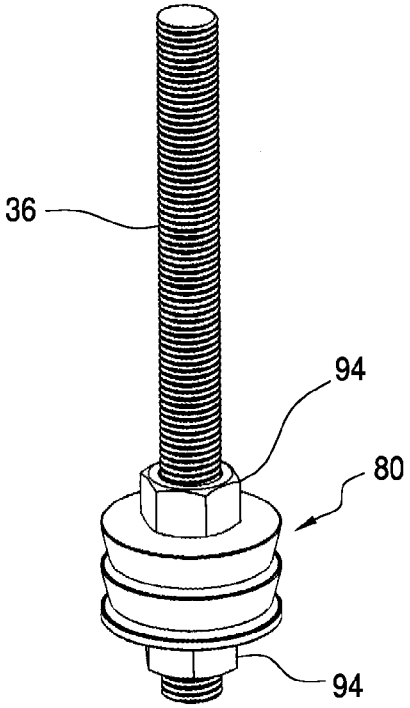
FIG. 17 is a perspective view of the anchor of FIG. 15, showing upper and lower nuts to attach the anchor body to the anchor rod.

Referring to FIG. 17, the anchor body 80 is secured to the anchor rod 36 with upper and lower nuts 94. In this embodiment, the opening 82 may be unthreaded.

Figure 18:
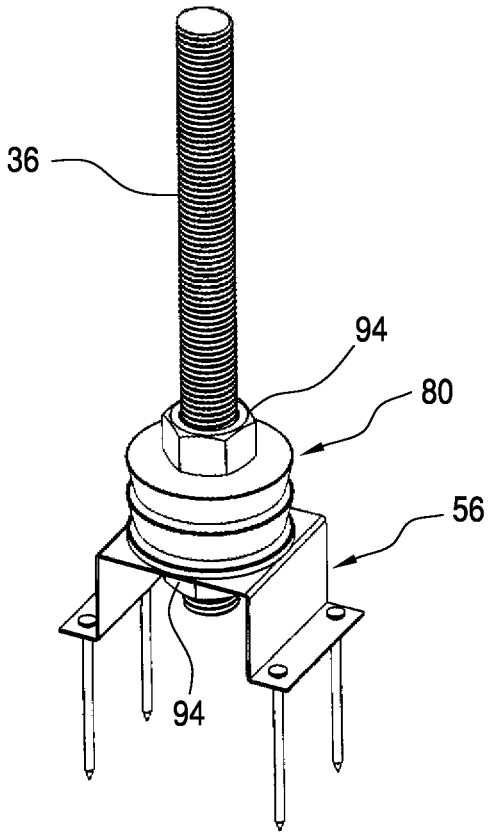
FIG. 18 is a perspective view of the anchor of FIG. 17 shown attached to a support.

Referring to FIG. 18, the anchor body 80 may be attached to the support 56, using the upper and lower nuts 94. It should be understood that the anchor shown in FIG. 13 may also be similarly attached to the support 56.

Figure 19:
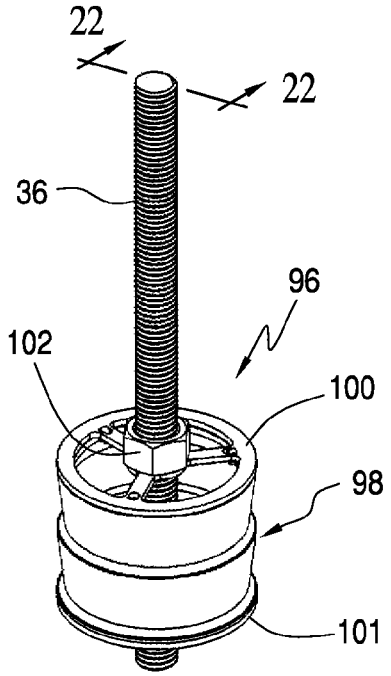
FIG. 19 is a top perspective view of another embodiment of an anchor made in accordance with the present invention.
Figure 21:
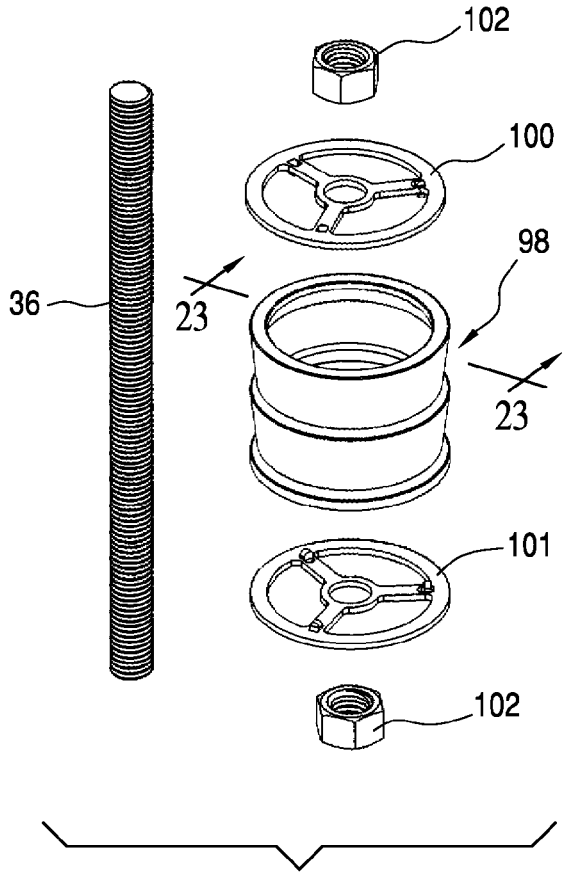
FIG. 21 is an assembly view of the anchor of FIG. 19.
Figure 20:
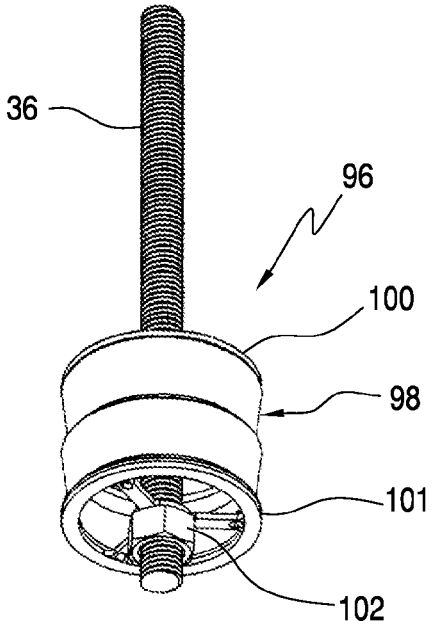
FIG. 20 is bottom perspective view of FIG. 19.

Referring to FIGS. 19, 20 and 21, another embodiment of an anchor 96 is disclosed. The anchor 96 comprises an anchor rod 36, an anchor body 98, and upper and lower spacers 100 and 101. The anchor rod 36 extends through the center of the anchor body 98. The upper and lower spacers 100 and 101 allow the anchor rod 36 to be centered through the anchor body 98. Upper and lower nuts 102 secure the spacers 100 and 101 to the anchor body 98 and the anchor rod 36.

Figure 22:
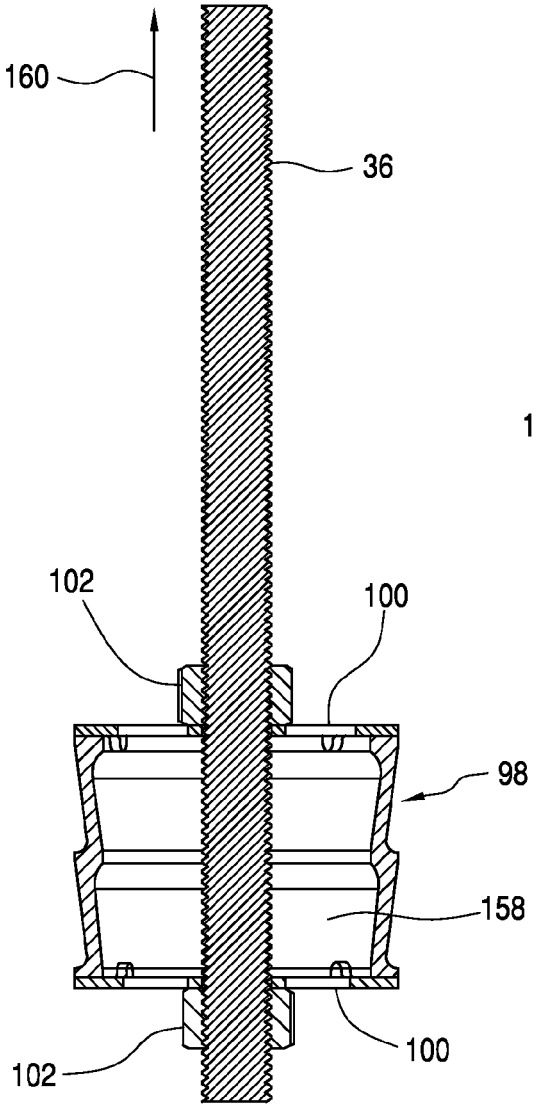
FIG. 22 is a cross-section view taken along line 22-22 in FIG. 19.

The anchor body 98 is a tubular member, preferably circular in cross-section, with a vertical wall 104 and top and bottom openings 106 and 108. The vertical wall 104 has outside surface 110 and inside surface 112. The outside surface 110 is shaped with a series of recessed profiles, similar to recessed profiles on the anchor body 80 of FIG. 16. The outside surface 104 has upper and lower downwardly and inwardly projecting surfaces 114 and 116, preferably shaped as inverted conical surfaces. The upper and lower surfaces 114 and 116 preferably terminate into respective outwardly extending curved surfaces 118 and 120 to define respective shoulders 122 and 124. Both shoulders 122 and 124 will generate respective shear cones when load in the direction 160 is applied on the anchor rod 36, as shown in FIG. 22. The lower shoulder 124 will generate a larger shear cone than the upper shoulder 122 due to its lower position. Multiple shoulders help to distribute the load on the wall 104 and thus make for a stronger anchorage.

The inside surface 112 similarly has upper and lower downwardly and inwardly extending surfaces 126 and 128, preferably shaped as inverted conical surfaces. Each surface 126 and 128 is capped at the top with respective inwardly extending curved surfaces 130 and 132. The surfaces 130 and 132 define respective inverted shoulders 134 and 136.

Figure 24:
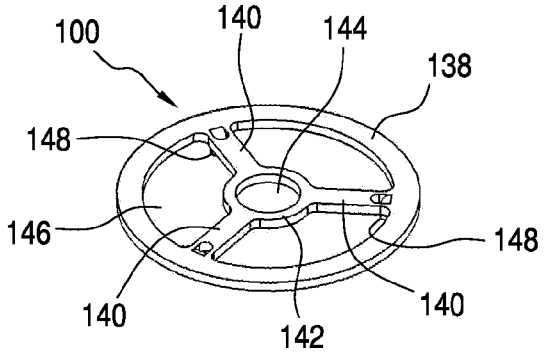
FIGS. 24 and 25 are enlarged perspective views of spacers used in the anchor of FIG. 19.

The upper and lower spacers 100 and 101 are identical to each other and are preferably made of molded plastic. Referring to FIG. 24, the spacer 100 has an outer ring 138 with radiating arms 140 joined to an inner ring 142. The inner ring 142 has an opening 144 through which the anchor rod 36 passes. Openings 146 allow the concrete slurry to flow through and fill up the void inside the anchor body 98. Downwardly projecting tabs 148 engage the inner edge 150 of the wall 104. The outer ring 138 is supported on top edge 152 of the wall 104.

Figure 25:
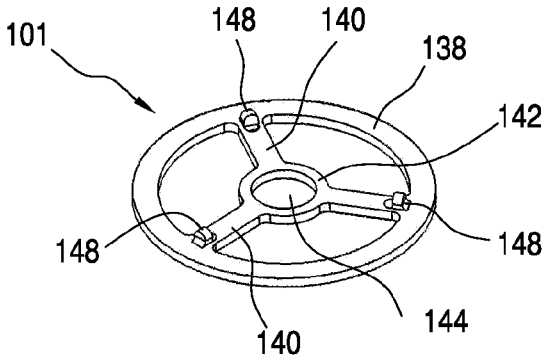

Referring to FIG. 25, the spacer 101 is identically constructed as the spacer 100, so that the same reference numbers are used to refer to identical parts. The tabs 148 are shown extending upwardly to engage the lower inner edge 154. The outer ring 138 engages the lower bottom edge 156.

Referring back to FIG. 22, concrete slurry fills up the void 158 within the anchor body 98 when the anchor 96 is embedded in the concrete structure, with the upper portion of the anchor rod 36 extending out of the structure for attachment to a load, such as another structure required to be anchored. When tension is applied on the anchor rod 36 in the upward direction 160, the concrete mass within the void 158 becomes subject to compression forces, as the inverted shoulders 134 and 136 deflect the upward force toward the lower nut 102 and the threads of the anchor rod 36 located within the anchor body 98. Accordingly, the anchor body 98 becomes a solid member, securely attached to the anchor rod 36, thereby allowing the outside shoulders 122 and 124 to counteract the pulling or tensile load on the anchor rod 36.

Figure 26:
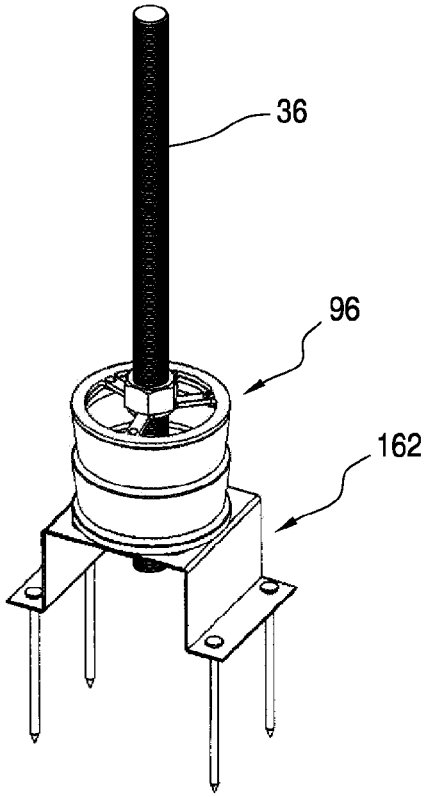
FIG. 26 is a perspective view of the anchor of FIG. 19 shown attached to a support.
Figure 27:
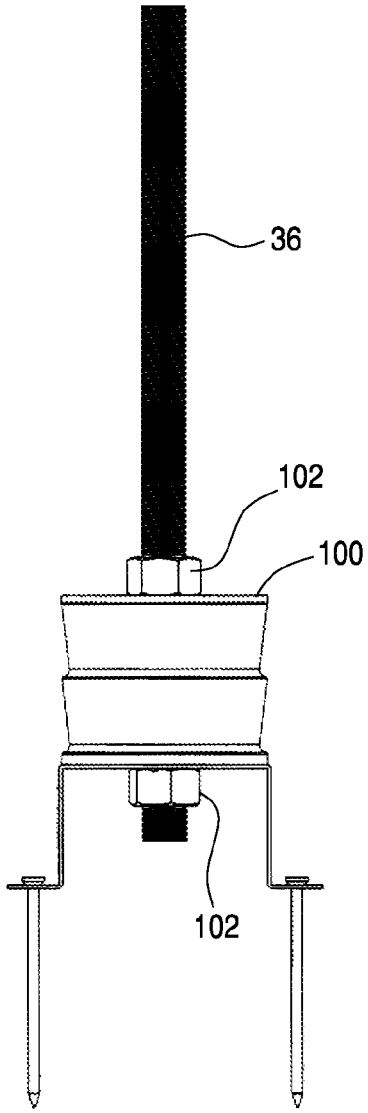
FIG. 27 is a side-elevational view of FIG. 26.
Figure 28:
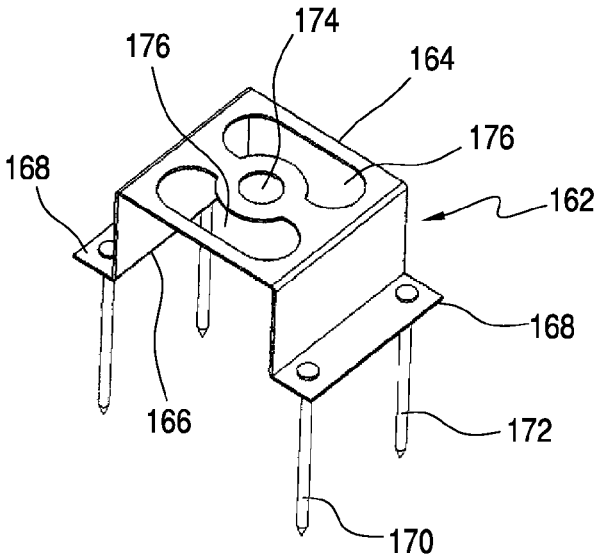
FIG. 28 is a perspective view of the support shown in FIG. 26.

Referring to FIGS. 26, 27 and 28, the anchor 96 may be supported on a support 162 for placement within a concrete form. When the support 162 is used, the lower spacer 101 may be omitted. The support 162 is made from sheet metal bent into a U-shape, with a horizontal base wall 164, vertical side walls 166 extending downwardly from opposite ends of the base wall 164 and footers 168 extending transversely from respective bottom edges of the side walls 162. The footers 168 are provided with holes 170 for the nails 172 used to attach the support 162 to a concrete form board.

The base wall 164 includes a central opening 174 through which the anchor rod 36 extends. Openings 176 disposed on either side of the central opening 174 communicate with the bottom opening 108 of the anchor body 96 when seated on top of the base wall 164. The openings 176 allow the concrete slurry to flow through inside the anchor body 98 to underneath the base wall 164 to minimize formation of air pockets within the anchor body 98.

The anchor 96 is attached to the support 162 by the lower nut 102 engaging the underside of the base wall 164 and the upper nut 102 pressing the upper spacer 100 and the anchor body 98 against the base wall 164.

In use, the lower portion of the anchor rod 36 is embedded in the concrete structure while its upper portion protrudes outside for connection to a load, such as a structure required to be tied down, such as the wall structure 2, using conventional connectors, such as a nut, a threaded coupler, a ring attached to the end of the anchor rod, etc.

When tension is applied on the anchor rod 36, in the upward direction for all the embodiments shown, a shear cone will develop at each of the shoulders on the vertical side surfaces of the anchor bodies. The side of the shear cone is 35° from the horizontal. The lower the shoulders are, the larger will the shear cones be, thereby providing a stronger anchorage.

It should be understood that the shoulders disclosed in the various embodiments of the anchor body may be provided in various ways without departing from the invention.

Figure 29:
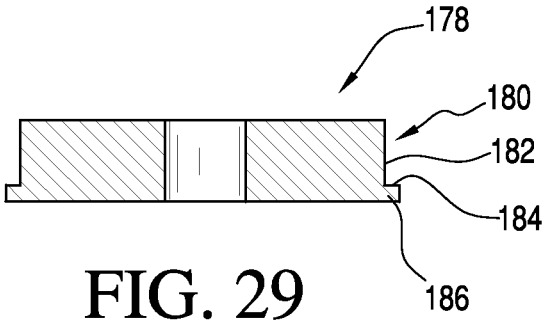
FIG. 29 is a cross-sectional view of another embodiment of the anchor body shown in FIG. 5.

Referring to FIG. 29, a rectangular metallic anchor body 178, similar to the anchor body 34 shown in FIG. 4, has vertical side surfaces in a L-shaped side profile with a vertical surface 182 and a horizontal outwardly extending surface 184 to provide a shoulder 186.

Figure 30:
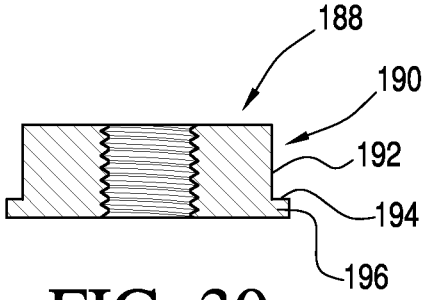
FIG. 30 is a cross-section view of another embodiment of the anchor body shown in FIG. 14.

Referring to FIG. 30, a substantially cylindrical metallic anchor body 188, similar to the anchor body shown in FIG. 13, has a sidewall surface 190 with a vertical cylindrical surface 192 and a horizontal outwardly extending surface to provide a shoulder 196.

Figure 31:
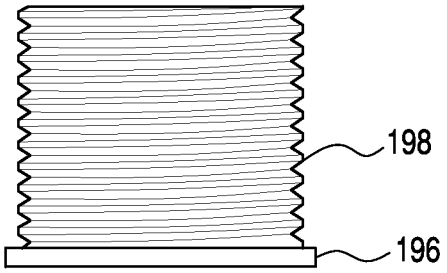
FIG. 31 is a side-elevational view of another embodiment of anchor body shown in FIG. 16.

Referring to FIG. 31, the vertical cylindrical surface of the anchor 188 may be provided with threads 198 that provide multiple shoulders in addition to or in lieu of the bottom shoulder 196. The threads 198 distribute the load on the surface 190. The threads 198 provide the function of a plurality of shoulders.

Figure 32:
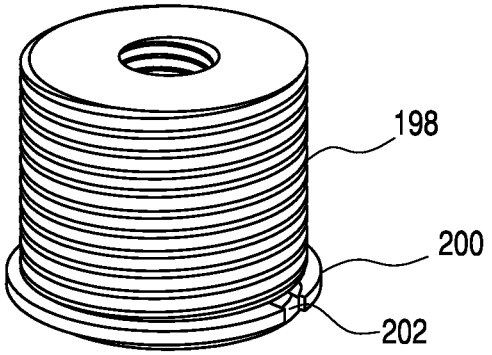
FIGS. 32-34 are perspective views of various embodiments of the anchor body shown in FIG. 16.
Figure 33:
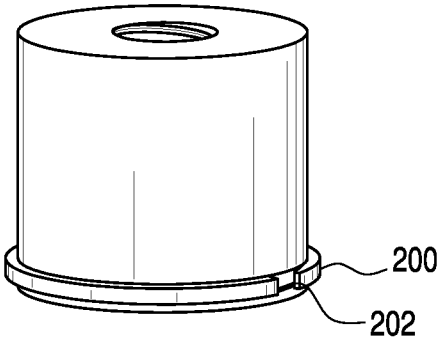

Referring to FIGS. 32 and 33, the shoulder 196 shown in FIGS. 30 and 31 may be provided by a split or C-ring ring 200 partly recessed into a circumferential groove 202 so that a portion extends outside the groove to form the shoulder.

Figure 34:
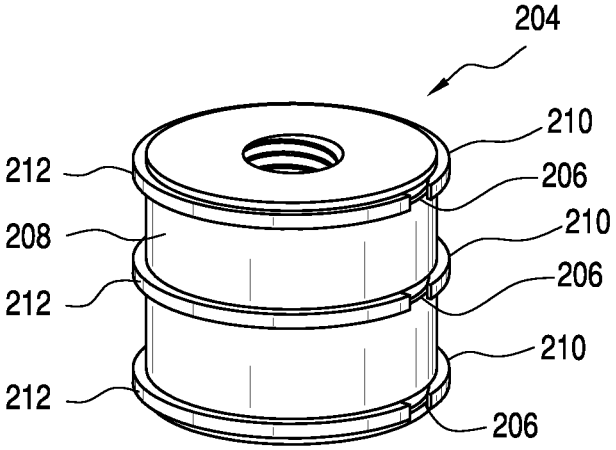

In the embodiment shown in FIG. 34, a metallic cylindrical anchor body 204 is provided with multiple circumferential grooves 206 on the cylindrical surface 208. Multiple split or C-rings 210 are disposed in respective grooves 206. Each ring 210 is partly received in the respective groove 206 so that a portion of the rings extends outwardly beyond the cylindrical surface 208 to provide a respective shoulder 212.

Figure 23:
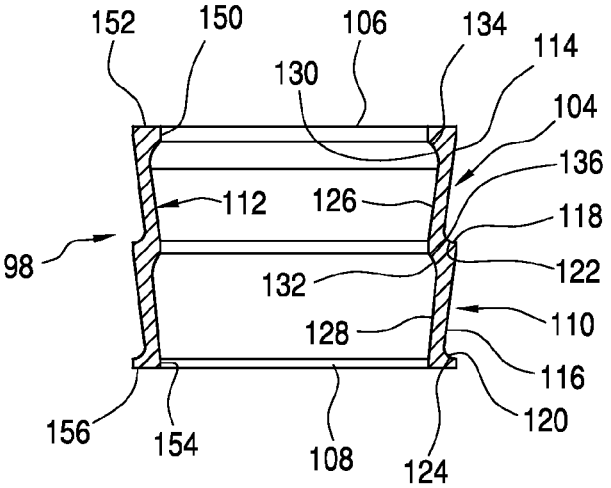
FIG. 23 is an enlarged cross-section view taken along line 23-23 in FIG. 21.
Figure 35:
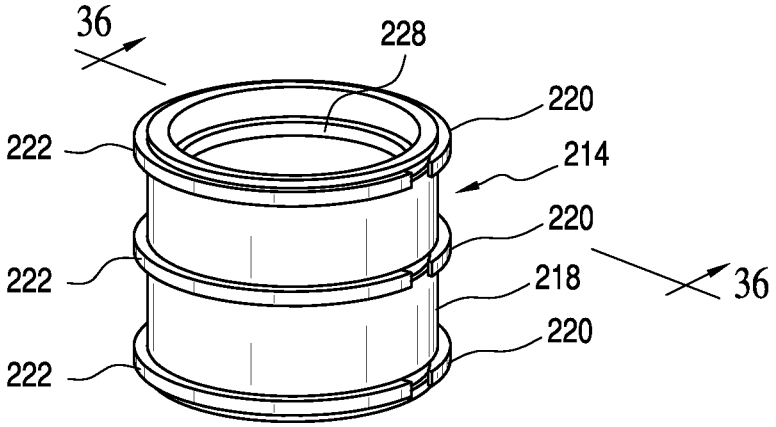
FIG. 35 is a perspective view of another embodiment of the anchor body shown in FIG. 23.
Figure 36:
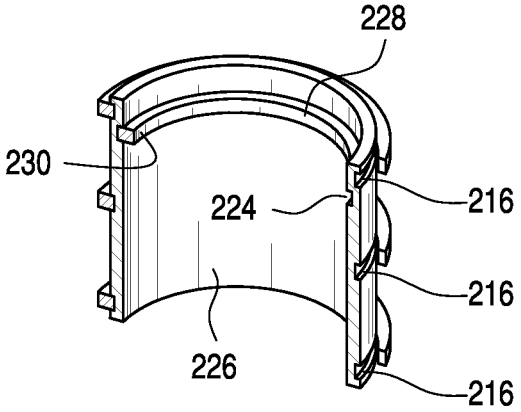
FIG. 36 is a cross-sectional view taken along line 36-36 in FIG. 35.

Referring to FIGS. 35 and 36, the outside shoulders 122 and 124 on the anchor body 98 shown in FIG. 23 may be implemented with a metallic, cylindrical sleeve 214 with a plurality of circumferential grooves 216 on its outside cylindrical surface 218 that partly receive respective split or C-rings 220. Portions of the rings 220 that extend outside the grooves 216 form shoulders 222. The inverted shoulder 134 shown in FIG. 23 is implemented with an inside circumferential groove 224 on an inside cylindrical surface 226 on the sleeve 214 that partly receives a split or C-ring 228 so that a portion of the ring extends outside the groove 224 to form a shoulder 230.

Figure 37:
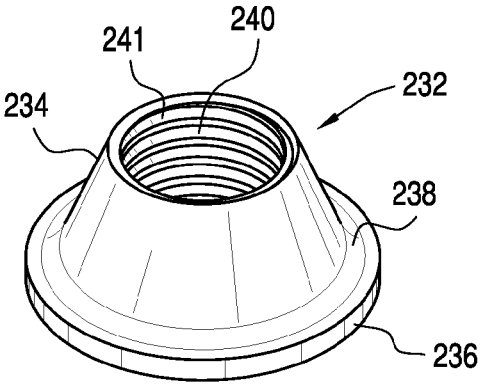
FIG. 37 is a perspective view of another embodiment of an anchor body embodying the present invention.
Figure 38:
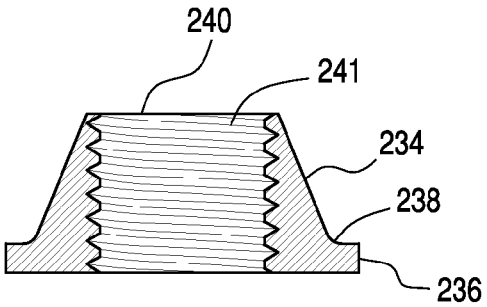
FIGS. 38 and 39 are cross-section side views of FIG. 37, with FIG. 39 showing a threadless axial opening.
Figure 39:
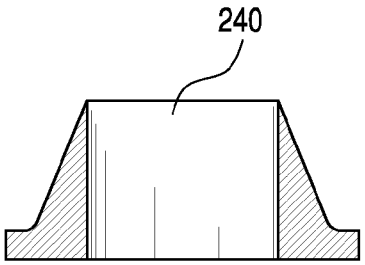

Referring to FIGS. 37 and 38, an anchor body 232 is disclosed, having a wedge shape in side view with a conical side wall 234, extending upwardly from the bottom from wide to narrow. The body 232 is circular in cross-section. The body 232 has an annular outwardly extending shoulder 236 with an upper surface 238. The shoulder 236 is advantageously disposed at the bottom portion of the anchor body. An opening 240 with inside threads 241 extending through the body 232 provides for attaching the body to an anchor rod. The conical surface 234 provides an increased load bearing surface as compared to a cylindrical surface. The opening 240 may be threadless as shown in FIG. 39.

Figure 40:
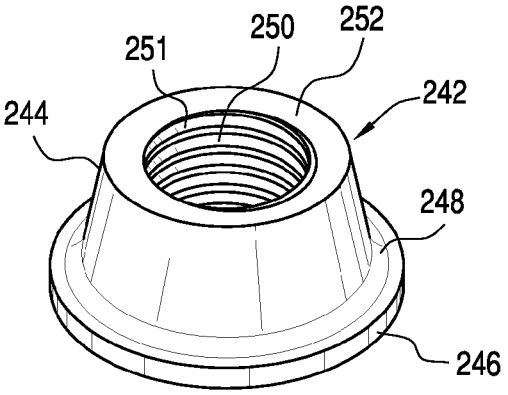
FIG. 40 is a perspective view of another embodiment of an anchor body embodying the present invention.
Figure 41:
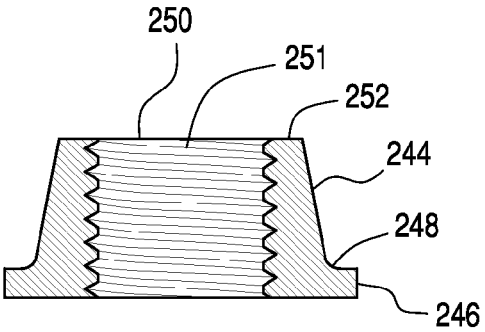
FIGS. 41 and 42 are cross-section side views of FIG. 40, with FIG. 42 showing a threadless axial opening.
Figure 42:
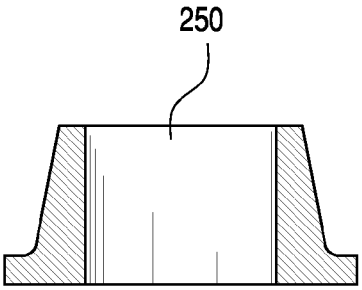

Referring to FIGS. 40 and 41, an anchor body 242 similar to the body 240 is disclosed. The anchor body 242 includes a wedge shape in side view with a conical side wall 244, extending upwardly from the bottom from wide to narrow. The body 242 is circular in cross-section. The body 242 has an annular outwardly extending shoulder 246 with an upper surface 248. The shoulder 246 is advantageously disposed at the bottom portion of the anchor body. An opening 250 with inside threads 251 extending through the body 242 provides for attaching the body to an anchor rod. The anchor body 242 includes an upper horizontal edge surface 252, providing an additional load bearing surface. As in the anchor body 240, the conical surface 244 provides an increased load bearing surface as compared to a cylindrical surface. The opening 250 may be threadless as shown in FIG. 42.

Figure 43:
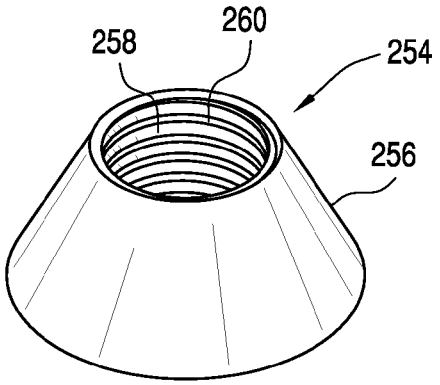
FIG. 43 is a perspective view of another embodiment of an anchor body embodying the present invention.
Figure 44:
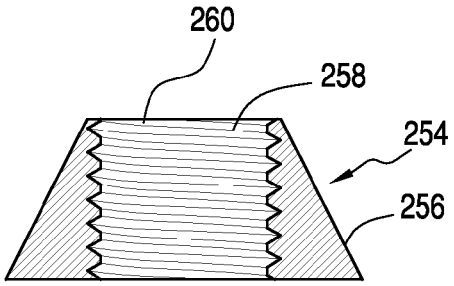
FIGS. 44 and 45 are cross-section side views of FIG. 43, with FIG. 45 showing a threadless axial opening.
Figure 45:
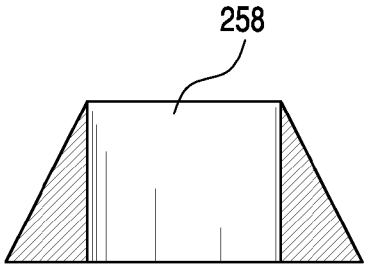

Referring to FIGS. 43 and 44, an anchor body 254 is disclosed, having a wedge shape in side view with a conical side wall 256. The body 254 is circular in cross-section. An opening 258 with inside threads 260 extending through the body 254 provides for attaching the body to an anchor rod. The conical surface 256 provides an increased load bearing surface as compared to a cylindrical surface. The opening 258 may be threadless as shown in FIG. 45.

Figure 46:
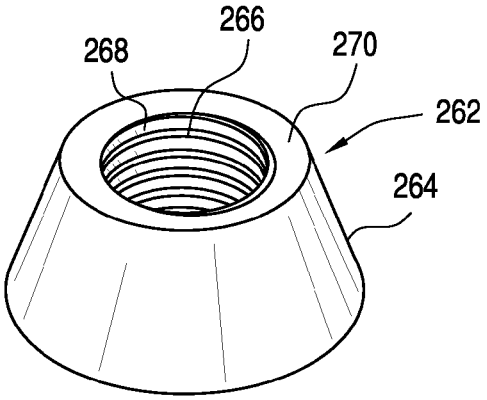
FIG. 46 is a perspective view of another embodiment of an anchor body embodying the present invention.
Figure 47:
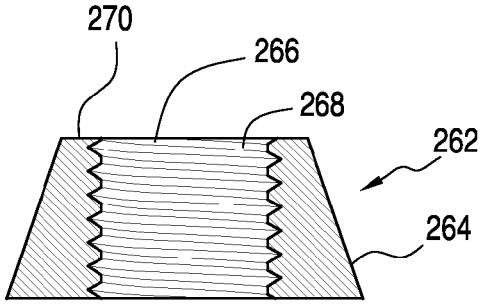
FIGS. 47 and 48 are cross-section side views of FIG. 48, with FIG. 46 showing a threadless axial opening.
Figure 48:
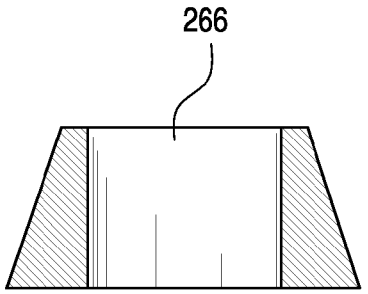

Referring to FIGS. 46 and 47, an anchor body 262 similar to the body 254 is disclosed. The anchor body 262 includes a wedge shape in side view with a conical side wall 264. The body 262 is circular in cross-section. An opening 266 with inside threads 268 extending through the body 262 provides for attaching the body to an anchor rod. The anchor body 262 includes an upper horizontal edge surface 270, providing an additional load bearing surface. The conical surface 264 provides an increased load bearing surface as compared to a cylindrical surface. The opening 266 may be threadless as shown in FIG. 48.

Figure 49:
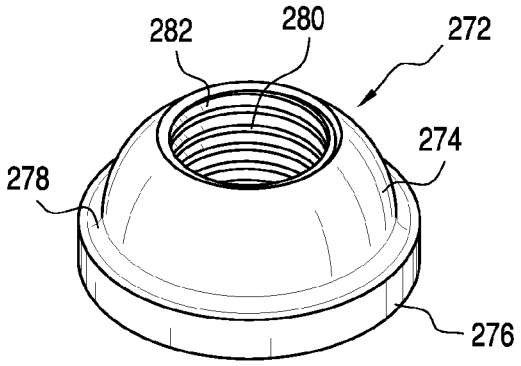
FIG. 49 is a perspective view of another embodiment of an anchor body embodying the present invention.
Figure 50:
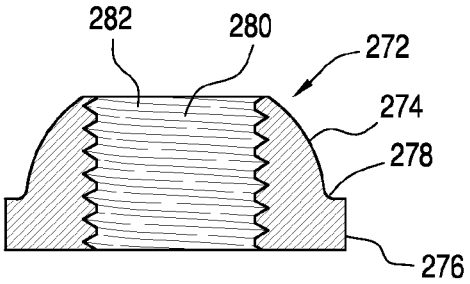
FIGS. 50 and 51 are cross-section side views of FIG. 49, with FIG. 51 showing a threadless axial opening.
Figure 51:
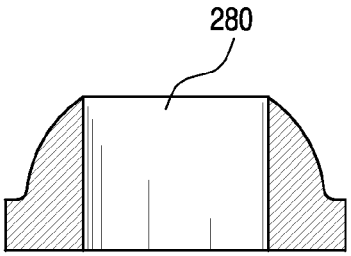

Referring to FIGS. 49 and 50, an anchor body 272 is disclosed, having a wedge shape in side view with a convex side wall 274, extending upwardly from the bottom from wide to narrow. The body 272 is circular in cross-section. The body 272 has an annular outwardly extending shoulder 276 with an upper surface 278. An opening 280 with inside threads 282 extending through the body 272 provides for attaching the body to an anchor rod. The convex surface 274 provides an increased load bearing surface as compared to a cylindrical surface. The opening 280 may be threadless as shown in FIG. 51.

Figure 52:
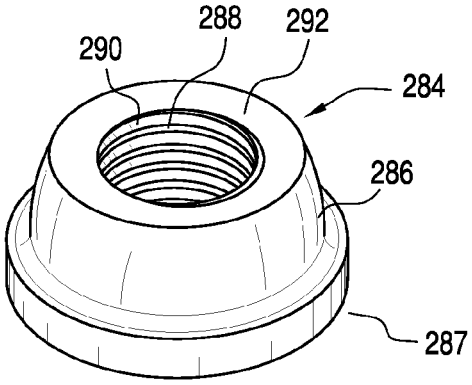
FIG. 52 is a perspective view of another embodiment of an anchor body embodying the present invention.
Figure 53:
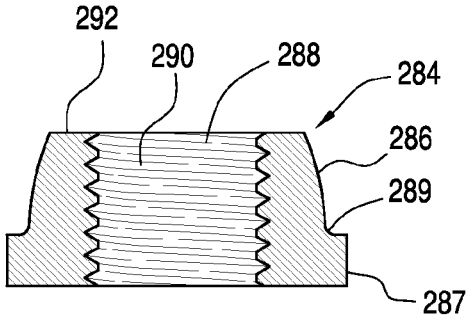
FIGS. 53 and 54 are cross-section side views of FIG. 52, with FIG. 54 showing a threadless axial opening.
Figure 54:
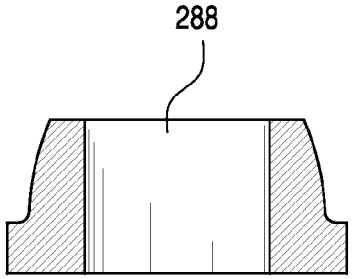

Referring to FIGS. 52 and 53, an anchor body 284 similar to the body 272 is disclosed. The anchor body 284 includes a wedge shape in side view with a convex side wall 286, extending upwardly from the bottom from wide to narrow. The body 284 is circular in cross-section. The body 284 has an annular outwardly extending shoulder 287 with an upper surface 289. The shoulder 287 is advantageously disposed at the bottom portion of the anchor body. An opening 288 with inside threads 290 extending through the body 284 provides for attaching the body to an anchor rod. The anchor body 242 includes an upper horizontal edge surface 292, providing an additional load bearing surface. As in the anchor body 272, the convex surface 286 provides an increased load bearing surface as compared to a cylindrical surface. The opening 288 may be threadless as shown in FIG. 54.

Figure 55:
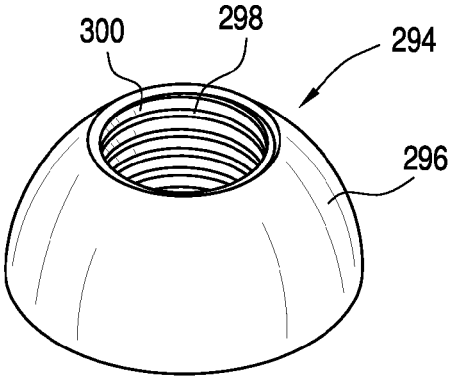
FIG. 55 is a perspective view of another embodiment of an anchor body embodying the present invention.
Figure 56:
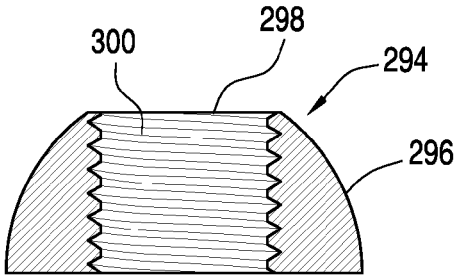
FIGS. 56 and 57 are cross-section side views of FIG. 55, with FIG. 57 showing a threadless axial opening.
Figure 57:
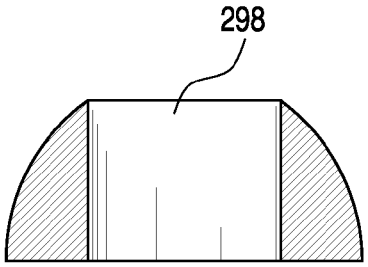

Referring to FIGS. 55 and 56, an anchor body 294 is disclosed, having a wedge shape in side view with a convex side wall 296. The body 294 is circular in cross-section. An opening 298 with inside threads 300 extending through the body 294 provides for attaching the body to an anchor rod. The convex surface 296 provides an increased load bearing surface as compared to a cylindrical surface. The opening 298 may be threadless as shown in FIG. 57.

Figure 58:
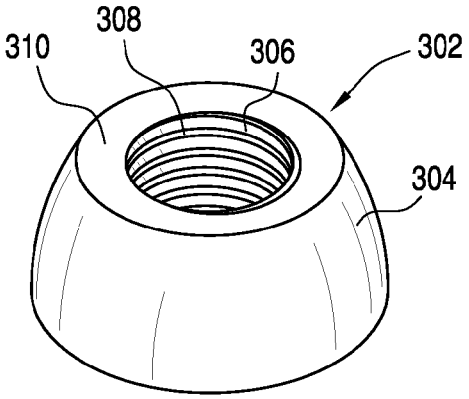
FIG. 58 is a perspective view of another embodiment of an anchor body embodying the present invention.
Figure 59:
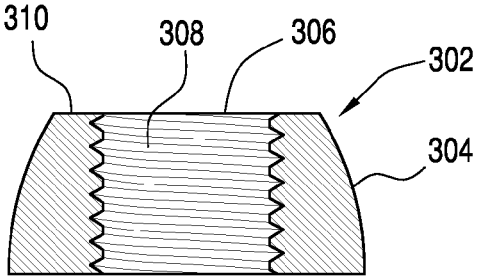
FIGS. 59 and 60 are cross-section side views of FIG. 58, with FIG. 60 showing a threadless axial opening.
Figure 60:
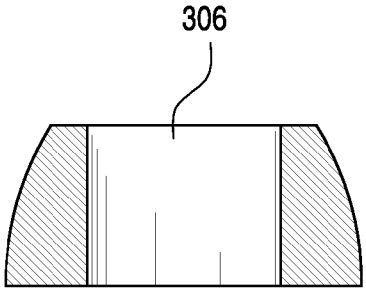

Referring to FIGS. 58 and 59, an anchor body 302 similar to the body 294 is disclosed. The anchor body 302 includes a wedge shape in side view with a convex side wall 304. The body 302 is circular in cross-section. An opening 306 with inside threads 308 extending through the body 302 provides for attaching the body to an anchor rod. The anchor body 302 includes an upper horizontal edge surface 310, providing an additional load bearing surface. The convex surface 304 provides an increased load bearing surface as compared to a cylindrical surface. The opening 306 may be threadless as shown in FIG. 60.

Figure 61A:
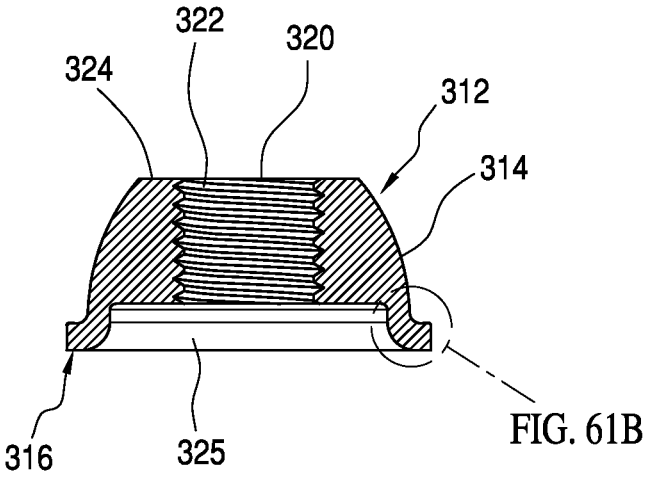
FIG. 61A is a side cross-sectional view of another embodiment of an anchor body embodying the present invention.

Referring to FIG. 61A, an anchor body 312 similar to the anchor body 284 is disclosed. The anchor body 312 includes a wedge shape with a convex side wall 314, extending upwardly from the bottom from wide to narrow. The body 312 is circular in cross-section. The body 312 has an annular outwardly extending shoulder 316 with an upper surface 318. The shoulder 316 is advantageously disposed at the bottom portion of the anchor body. An opening 320 with inside threads 322 extending through the body 312 provides for attaching the body to an anchor rod. The anchor body 312 includes an upper horizontal edge surface 324, providing an additional load bearing surface. A recess or undercut portion 325 is provided at a bottom portion of the anchor body 312. The undercut portion 325 allows a lower placement of the shoulder 316 in the concrete when used with an anchor rod holder or support, such that disclosed in applicant's copending application, Ser. No. 61/202,185, incorporated herein by reference. The undercut portion further allows less material to be used during manufacture without substantially decreasing the strength of the body. As in the anchor body 312, the convex surface 314 provides an increased load bearing surface as compared to a cylindrical surface.

Figure 61B:
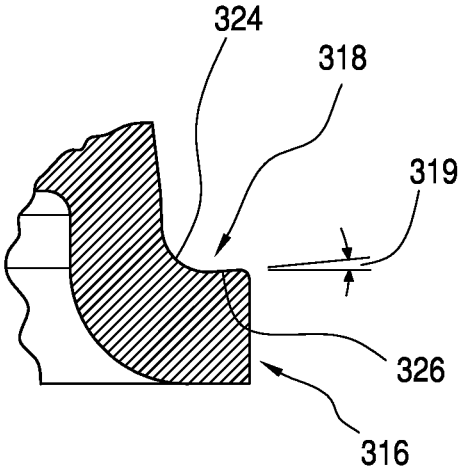
FIG. 61B is an enlarged view of detail A in FIG. 61A.

The surface 318 includes a concave, radius surface 324 and a ramping and radially extending generally horizontal surface 326 away from the surface 324, as shown enlarged in FIG. 61B. The surface 326 makes at an angle 319 above the horizontal plane of about 1°-15°. The configuration of the surface 318 provides for a stronger load bearing surface when embedded in concrete.

It is should be understood that the undercut portion 325 and the configuration of the surface 318 are applicable to all the solid anchor bodies disclosed herein with integral shoulders.

Figure 62:
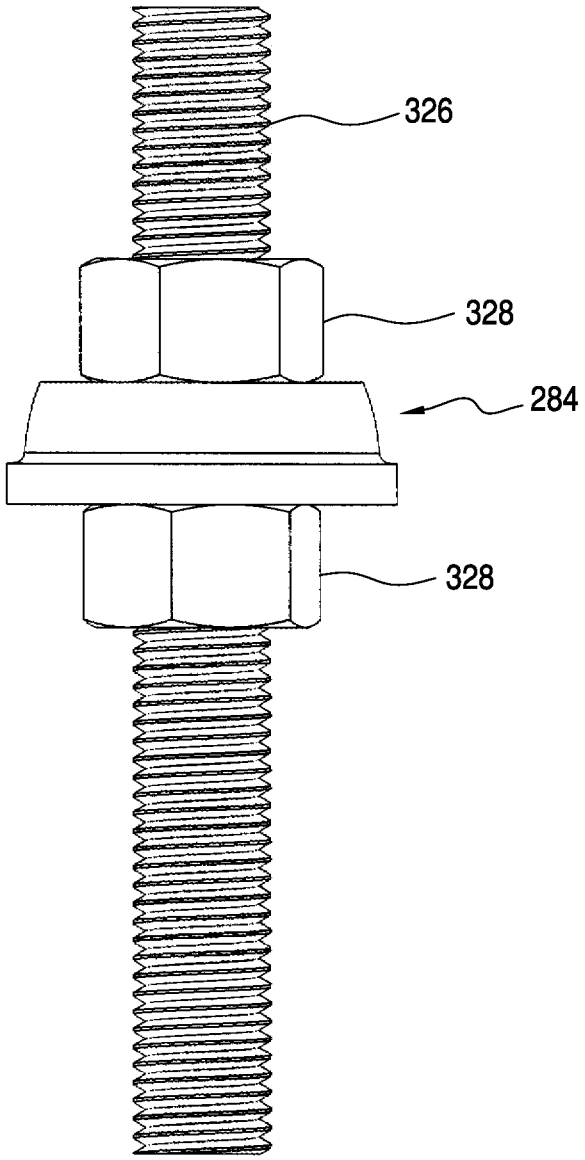
FIG. 62 is a side view of an anchor body shown in 54 shown attached to an anchor rod with nuts.

Referring to FIG. 62, an anchor body 284 with the threadless opening 288 is shown attached to an anchor rod 326 with nuts 328.

It should be understood that the anchors disclosed herein, when in use, are embedded in concrete as shown for the anchor 32 in FIG. 4.

It should be understood that although the anchor disclosed herein has been described for holding a structure, such as a wall, toward the foundation structure or concrete deck, the anchor can also be used to support any tensile load imposed on the anchor rod in any direction, such as a hanging weight, side attachment to a concrete column, attachment of a structure to underneath a concrete deck, etc. Accordingly it would be seen from the description that the anchor when embedded in a concrete structure will resist a tensile load on the anchor rod, regardless of the orientation of the direction of the tensile force.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An anchor for supporting a load, comprising:
a) an anchor rod having a lower threaded portion for being embedded in a concrete structure and an upper portion for attachment to a load;
b) a metallic tubular body operably attached to said lower threaded portion;
c) said tubular body including a sidewall, a top opening and a bottom opening, said sidewall including inside and outside surfaces;
d) at least one shoulder extending outwardly from said outside surface;
e) a shoulder extending inwardly from said inside surface; and
f) said lower threaded portion is disposed within said tubular body, said lower threaded portion is spaced apart from any portion of said tubular body.

2. An anchor as in claim 1, wherein said outside surface above said at least one shoulder is conical.

3. An anchor as in claim 1, wherein:
a) said outside surface is a recessed profile defined by a downwardly and inwardly projecting surface and an outwardly projecting surface defining said at least one shoulder; and
b) said inwardly and downwardly projecting surface terminates into said outwardly projecting surface on said outside surface.

4. An anchor as in claim 1, wherein said inside surface is a recessed profile defined by a downwardly and inwardly projecting surface and an inwardly projecting surface defining said shoulder of said inside surface.

5. An anchor as in claim 4, wherein said shoulder of said inside surface is disposed above said inwardly and downwardly projecting surface on said inside surface.

6. An anchor as in claim 1, and further comprising:
a) upper and lower spacers disposed on said top and bottom openings, respectively; and
b) said upper and lower spacers including a respective central opening through which said lower threaded portion extends.

7. An anchor as in claim 6, wherein:
a) said top and bottom openings include respective peripheries; and
b) said upper and lower spacers include projecting members that engage respective said peripheries.

8. An anchor as in claim 7, wherein:
a) said upper and lower spacers each includes an outer ring and an inner ring; and
b) radiating arms joined to said outer ring and said inner ring.

9. An anchor as in claim 8, and further comprising a support attached to said tubular body.

10. An anchor as in claim 9, wherein:
a) said support is formed from sheet metal bent into an inverted U-shape having a base wall and side walls extending downwardly from said base wall; and
b) said tubular body is attached to said base wall.

11. An anchor as in claim 10, wherein said base wall includes openings communicating with the interior of said tubular body.

12. An anchor as in claim 1, wherein:
a) said tubular body is a cylindrical sleeve;
b) said outside surface includes at least one circumferential groove;
c) a split ring partly disposed in said at least one circumferential groove such that a portion of said ring extends outside said groove beyond said outside surface; and
d) said portion of said ring comprises said at least one shoulder.

13. An anchor as in claim 1, wherein:
a) said inside surface includes a circumferential groove;
b) a split ring partly disposed in said groove such that a portion of said ring extends outside said groove beyond said inside surface; and
c) said portion of said ring comprises said shoulder of said inside surface.

14. An anchor for supporting a load, comprising:
a) an anchor rod having a lower threaded portion for being embedded in a concrete structure and an upper portion for attachment to a load;
b) a metallic tubular body operably attached to said lower threaded portion;
c) said tubular body including a sidewall, a top opening and a bottom opening, said sidewall including inside and outside surfaces;
d) at least one shoulder extending outwardly from said outside surface;
e) a shoulder extending inwardly from said inside surface; and
f) said lower threaded portion extending through said openings past said tubular body.

15. An anchor for supporting a load, comprising:
a) an anchor rod having a lower threaded portion for being embedded in a concrete structure and an upper portion for attachment to a load;
b) a metallic tubular body operably attached to said lower threaded portion;
c) said tubular body including a sidewall, a top opening and a bottom opening, said sidewall including inside and outside surfaces;

d) at least one shoulder extending outwardly from said outside surface;

e) a shoulder extending inwardly from said inside surface;

f) upper and lower spacers disposed on said top and bottom openings, respectively; and g) said upper and lower spacers including a respective central opening through which said lower threaded portion extends.

* * * * *